US009397432B2

(12) United States Patent
Yukutake et al.

(10) Patent No.: US 9,397,432 B2
(45) Date of Patent: Jul. 19, 2016

(54) CONNECTOR

(71) Applicant: IRISO ELECTRONICS CO., LTD., Kanagawa (JP)

(72) Inventors: Hiroaki Yukutake, Kanagawa (JP); Hiroaki Kobayashi, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 14/279,854

(22) Filed: May 16, 2014

(65) Prior Publication Data

US 2014/0342614 A1 Nov. 20, 2014

(30) Foreign Application Priority Data

May 20, 2013 (JP) ..... 2013-106599

(51) Int. Cl.

| | |
|---|---|
| ***H01R 13/64*** | (2006.01) |
| ***H01R 13/46*** | (2006.01) |
| ***H01R 12/91*** | (2011.01) |
| ***H01R 13/631*** | (2006.01) |
| *H01R 12/70* | (2011.01) |
| *H01R 13/533* | (2006.01) |

(52) U.S. Cl.

CPC ..... *H01R 13/46* (2013.01); *H01R 12/91* (2013.01); *H01R 13/6315* (2013.01); *H01R 12/7076* (2013.01); *H01R 13/533* (2013.01); *H01R 2201/26* (2013.01)

(58) Field of Classification Search

CPC ... H01R 13/6315; H01R 13/631; H01R 12/57
USPC ..... 439/246, 247, 248, 626
See application file for complete search history.

(56) References Cited

U.S. PATENT DOCUMENTS

| | | | | | |
|---|---|---|---|---|---|
| 4,061,410 | A * | 12/1977 | Kubik | H05K 3/222 | 439/491 |
| 5,112,235 | A * | 5/1992 | Enomoto | H01R 12/712 | 439/246 |
| 5,201,663 | A * | 4/1993 | Kikuchi | H01R 13/6315 | 439/248 |
| 5,306,169 | A * | 4/1994 | Fukushima | H01R 12/712 | 439/248 |
| 5,613,877 | A * | 3/1997 | Patel | H01R 12/7023 | 439/567 |
| 6,039,590 | A * | 3/2000 | Kunishi | H01R 13/6315 | 439/247 |
| 6,155,858 | A * | 12/2000 | Ozawa | H01R 13/6315 | 439/248 |
| 6,347,950 | B1 * | 2/2002 | Yokoyama | H01R 13/6315 | 439/248 |
| 6,939,154 | B2 * | 9/2005 | Horikoshi | G11B 33/08 | 439/247 |
| 7,186,126 | B2 * | 3/2007 | Umehara | H01R 13/33 | 439/247 |
| 7,534,123 | B2 * | 5/2009 | Koga | H01R 12/724 | 439/248 |
| 2006/0258199 | A1 * | 11/2006 | Umehara | H01R 13/33 | 439/247 |

* cited by examiner

*Primary Examiner* — Abdullah Riyami
*Assistant Examiner* — Thang Nguyen
(74) *Attorney, Agent, or Firm* — Hauptman Ham, LLP

(57) ABSTRACT

A connector is provided to sufficiently absorb the displacements of a plurality of connection objects with respect to a substrate even when the plurality of connection objects are connected. Two movable housings are formed by separate members that can move relative to each other, thereby absorbing the displacements of two mating connectors connected to the respective movable housings by each of the respective movable housings. This can sufficiently absorb the displacements of the mating connectors relative to a substrate.

4 Claims, 6 Drawing Sheets

CONNECTOR

BACKGROUND OF THE INVENTION

1. Field of the Invention

The present invention relates to connectors mounted on, for example, circuit boards for various electrical appliances so as to be connected to the terminals of mating connectors.

2. Description of the Related Art

Such a conventionally known connector includes a stationary housing fixed to a substrate, a movable housing that is movably provided relative to the stationary housing and accommodates a connection object inserted from one end of the movable housing, and a plurality of terminals, each being disposed with one end held by the movable housing and the other end held by the stationary housing. The connector allows the connection object inserted into the movable housing to come into contact with one end of the terminal while causing elastic deformation of the terminals to accept a movement of the movable housing with respect to the stationary housing (for example, Japanese Patent Publication No. 2007-18785).

In some cases, the connector is connected to a plurality of mating connectors, each including at least one mating terminal. In the case of the connector, however, the mating connectors are connected to the single movable housing. Thus, for example, even if only some of the mating connectors are displaced from the connector or the mating connectors are displaced in different directions to each other, the movable housing cannot move with all the mating connectors and thus cannot sufficiently absorb the displacements of the mating connectors under vibrations or an impact.

BRIEF SUMMARY OF THE INVENTION

The present invention has been devised in view of the problem. An object of the present invention is to provide a connector that can sufficiently absorb the displacements of a plurality of connection objects with respect to a substrate even when the plurality of connection objects are connected.

In order to attain the object, the present invention provides a connector including: a stationary housing fixed to a substrate; at least one movable housing that is movably provided relative to the stationary housing and allows the insertion of a connection object from one end of the movable housing; and a plurality of terminals, each being disposed with one end held by the movable housing and the other end held by the stationary housing, the connector allowing the connection object inserted into the movable housing to come into contact with one end of the terminal while causing elastic deformation of the terminals to accept a movement of the movable housing with respect to the stationary housing, the at least one movable housing including multiple movable housings, the movable housings being formed by separate members that are capable of moving relative to each other.

Thus, when a plurality of connection objects are connected, the connection objects are connected to the movable housings, and if the substrate and the connection objects are displaced from each other under vibrations or an impact, the elastic deformation of the terminals accepts the movements of the movable housings, allowing the movable housings to separately absorb the displacements of the connection objects.

According to the present invention, even if a plurality of connection objects are connected, the displacements of the connection objects connected to the movable housings can be separately absorbed by the movable housings, thereby sufficiently absorbing the displacements of the connection objects relative to the substrate. The present invention is quite useful for vehicle-installed electrical appliances used under large vibrations or a large impact.

DETAILED DESCRIPTION OF THE INVENTION

Figure 1:
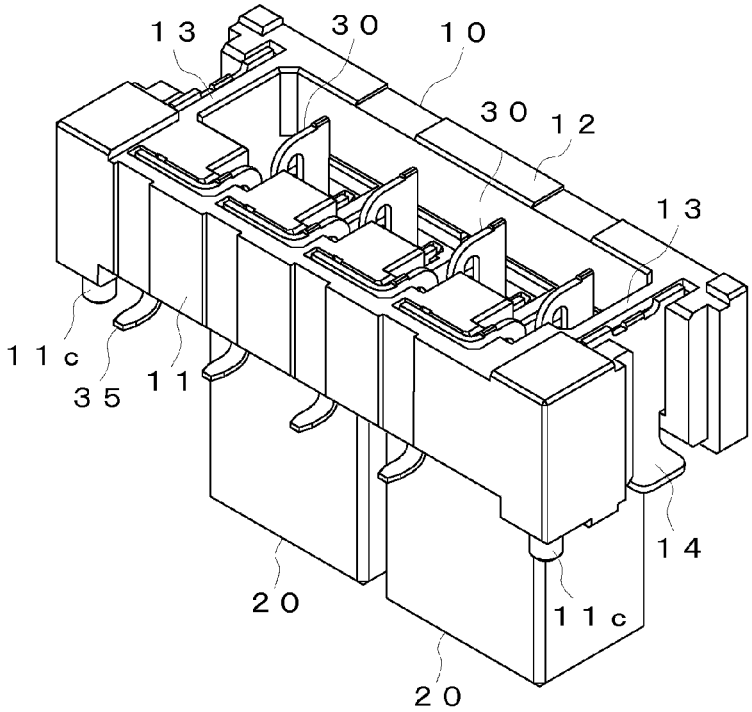
FIG. 1 is a front perspective view of a connector according to an embodiment of the present invention.
Figure 2:
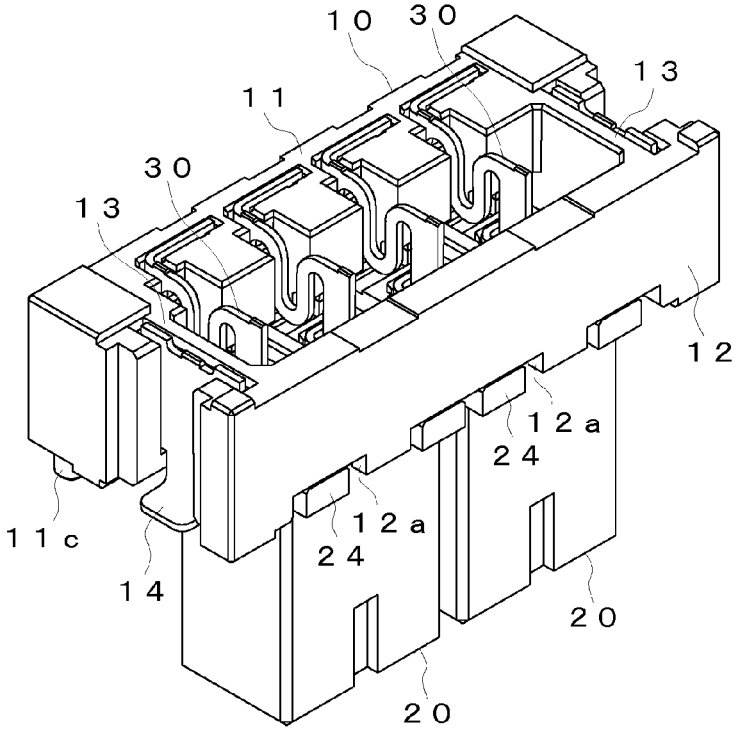
FIG. 2 is a rear perspective view of the connector.
Figure 3:
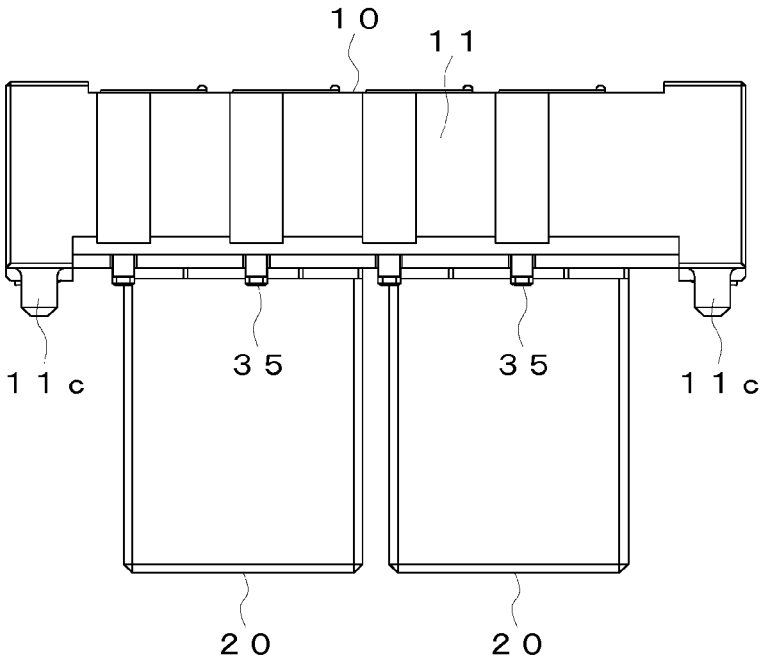
FIG. 3 is a front view of the connector.
Figure 4:
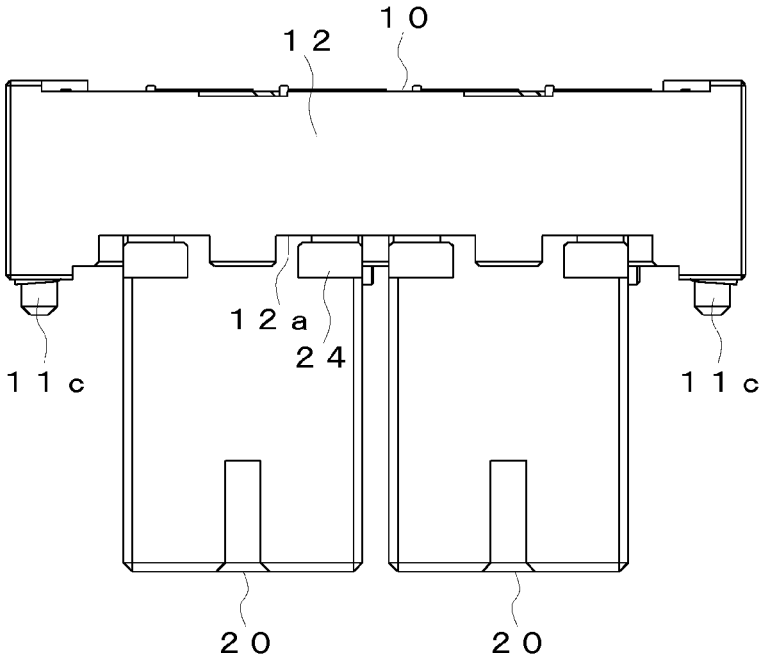
FIG. 4 is a rear view of the connector.
Figure 5:
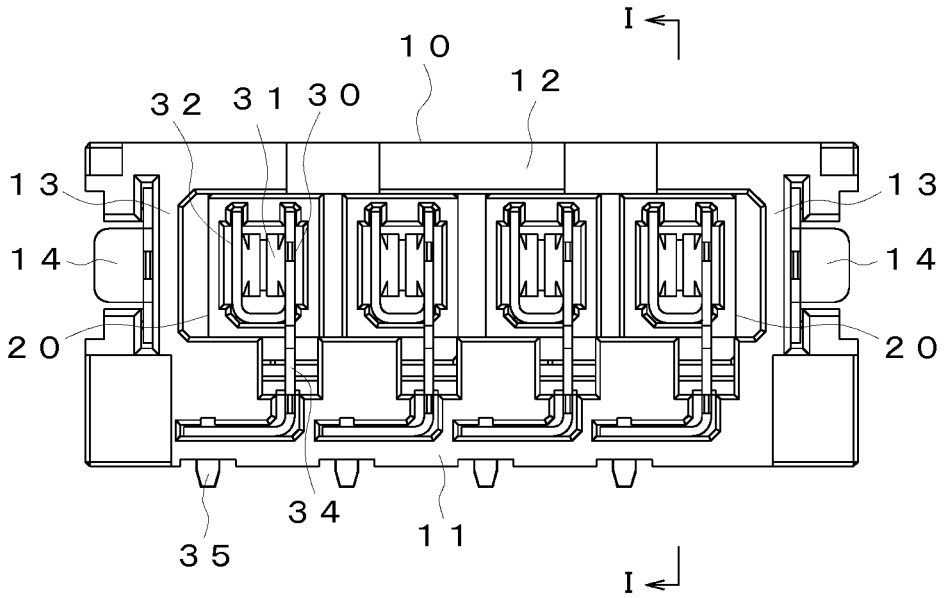
FIG. 5 is a plan view of the connector.
Figure 6:
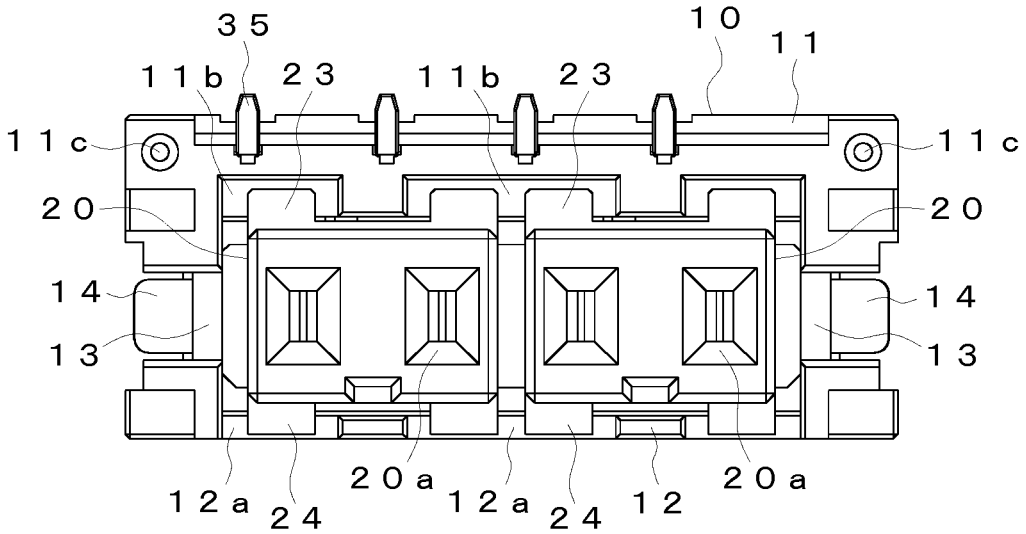
FIG. 6 is a rear view of the connector.
Figure 7:
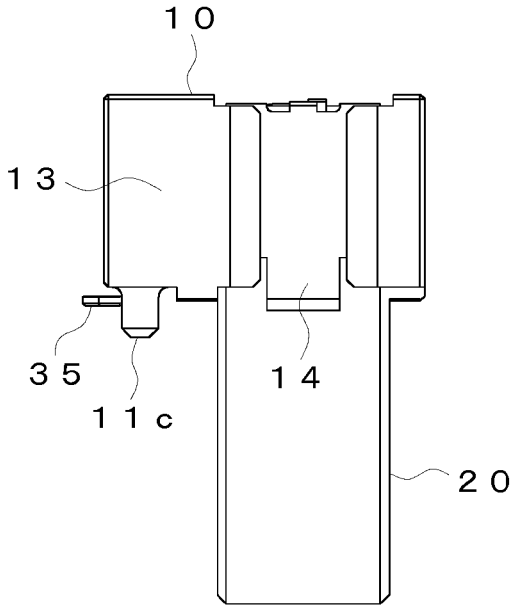
FIG. 7 is a side view of the connector.
Figure 8:
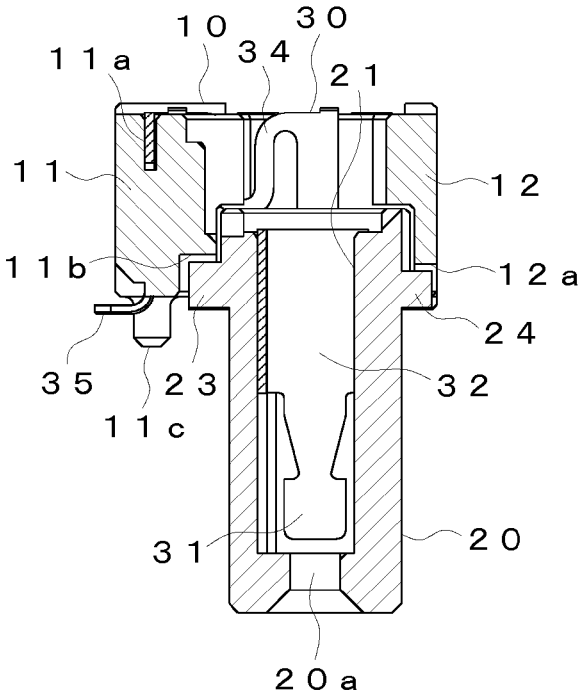
FIG. 8 is a cross-sectional view taken along line I-I of FIG. 5.
Figure 9:
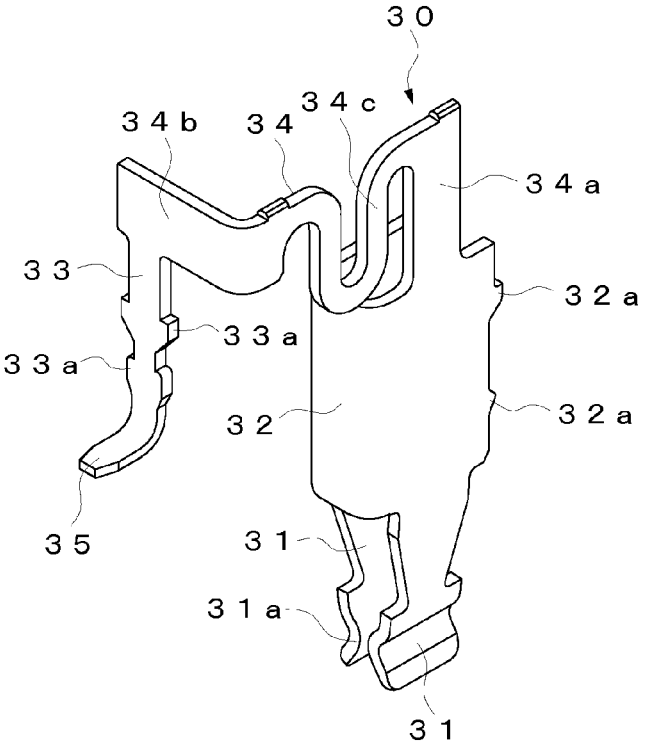
FIG. 9 is a perspective view of a terminal.

FIGS. 1 to 11 show a connector mounted on circuit boards for various electrical appliances according to an embodiment of the present invention.

The connector is mounted on a substrate 1 and is connected to a plurality of mating connectors 2 serving as connection objects. The mating connector 2 includes two pin-type mating terminals 3 held by an insulating member 4.

The connector according to the present embodiment includes a stationary housing 10 where the mating terminals 3 are inserted from the bottom, two movable housings 20 provided so as to move in a longitudinal direction (X direction), a width direction (Y direction), and a vertical direction (Z direction) with respect to the stationary housing 10, and four terminals 30, each being disposed with one end held by the movable housing 20 and the other end held by the stationary housing 10. The terminals 30 are spaced in the width direction of the stationary housing 10.

The stationary housing 10 is a molded article of synthetic resin. The stationary housing 10 is longer in the width direction than in the longitudinal direction. The stationary housing 10 is a hollow body surrounded by a front part 11, a rear part 12, and left and right side parts 13. The top surface and undersurface of the stationary housing 10 are opened above and below. The front part 11 has four terminal grooves 11*a*, each holding the other end of the terminal 30 so as to press the other end of the terminal 30 into the terminal groove 11*a*. The lower end of the front part 11 and the lower end of the rear part 12 are respectively provided with a first concave portion 11*b* and a second concave portion 12*a* that are in contact with the movable housings 20. Furthermore, protrusions 11*c* for positioning the front part 11 relative to the substrate 1 are provided on both ends in the width direction of the undersurface of the front part 11. Moreover, the side parts 13 each have a metallic fixing member 14 for fixing the stationary housing 10 to the substrate 1.

The movable housings 20 are molded articles that are made of synthetic resin and are identical in shape. The movable housings 20 are formed by separate members relatively movable to each other. Furthermore, the movable housing 20 is shaped like a rectangular parallelepiped that is longer in the vertical direction than in the longitudinal and width directions and is disposed on a lower part in the stationary housing 10 so as to move in the longitudinal, width, and vertical directions. The movable housing 20 has two terminal holes 21, each holding one end of the terminal 30. One end of the terminal 30 is pressed into the terminal hole 21 so as to be fixed to the movable housing 20. The undersurface of the movable housing 20 has two insertion openings 22 where the mating terminals 3 are inserted. An opening of the insertion openings 22 gradually expand downward. A pair of first protrusions 23 protruding forward are spaced in the width direction on the upper part of the front of the movable housing 20. The first protrusion 23 moves upward into contact with the upper end face of the first concave portion 11*b* of the stationary housing 10. Moreover, a pair of second protrusions 24 protruding rearward are spaced in the width direction on the upper part of the rear of the movable housing 20. The second protrusions 24 move upward into contact with the upper end face of the second concave portion 12*a* of the stationary housing 10.

The terminals 30 are formed by punching and bending of a metallic plate and are spaced in the width direction. The terminal 30 includes a pair of contact portions 31 in contact with the mating terminals 3, a first fixed portion 32 fixed in the movable housing 20, a second fixed portion 33 fixed in the stationary housing 10, a movable portion 34 that is an elastically deformable portion formed between the first fixed portion 32 and the second fixed portion 33, and a substrate joint 35 connected to the substrate 1.

The contact portions 31 are provided on one end of the terminal 30 and are formed to oppose to each other in the width direction of the terminal 30. The contact portions 31 are formed so as to elastically deform in the width direction of the terminal 30. The mating terminal 3 is pressed between contact portions 31*a* that are formed in a shape protruding toward each other.

The first fixed portion 32 is provided on one end of the terminal 30 and is held by the movable housing 20. The first fixed portion 32 is substantially shaped like a letter U that is opened at the rear end of the terminal, and the contact portions 31 are extended below from the lower ends of the side parts. Locking portions 32*a* locked to the internal surface of the terminal hole 21 of the movable housing 20 protrude at the rear ends of the side parts of the first fixed portion 32. The first fixed portion 32 is pressed into the terminal hole 21 so as to lock the locking portions 32*a*, thereby fixing the first fixed portion 32 into the movable housing 20.

The second fixed portion 33 is provided on the other end of the terminal 30 and is held by the stationary housing 10. The second fixed portion 33 is formed to vertically extend and has locking portions 33*a* that protrude on both ends in the width direction of the second fixed portion 33 so as to be locked into the terminal groove 11*a* of the stationary housing 10. In other words, the second fixed portion 33 is pressed into the terminal groove 11*a* so as to lock the locking portion 33*a*. Thus, the second fixed portion 33 is fixed to the stationary housing 10.

The movable portion 34 includes a first elastic piece 34*a* extending upward from the first fixed portion 32, a second elastic piece 34*b* extending from the upper end of the second fixed portion 33 in the width direction of the terminal 30, and a third elastic piece 34*c* that is formed to be substantially bent like a letter U between the first elastic piece 34*a* and the second elastic piece 34*b*. The movable portion 34 is elastically deformed in the longitudinal, width, and vertical directions by the elastic pieces 34*a*, 34*b*, and 34*c*.

The substrate joint 35 is formed so as to extend from the lower end of the second fixed portion 33 to the front of the terminal 30. The end of the substrate joint 35 is formed to gradually decrease in width toward the front of the terminal 30.

The connector configured thus is disposed on the top surface (one surface) of the substrate 1. The fixing members 14 of the stationary housing 10 and the substrate joints 35 of the terminals 30 are soldered to the substrate 1, thereby fixing the connector to the substrate 1. At this point, the protrusions 11*c* of the stationary housing 10 are engaged with positioning holes 1*a* provided on the substrate 1; meanwhile, the lower ends of the movable housings 20 are inserted into openings 1*b* provided on the substrate 1. The opening 1*b* is formed to be slightly larger than the outer periphery of the movable housing 20. The first and second protrusions 23 and 24 of the movable housings 20 are disposed between the top surface of the substrate 1 and the first and second concave portions 11*b* and 12*a* of the stationary housing 10. In this case, the vertical size of the first protrusion 23 is formed to be smaller than a height from the top surface of the substrate 1 to the upper end face of the first concave portion 11*b* while the vertical size of the second protrusion 24 is formed to be smaller than a height from the top surface of the substrate 1 to the upper end face of the second concave portion 12*a*.

Figure 10:
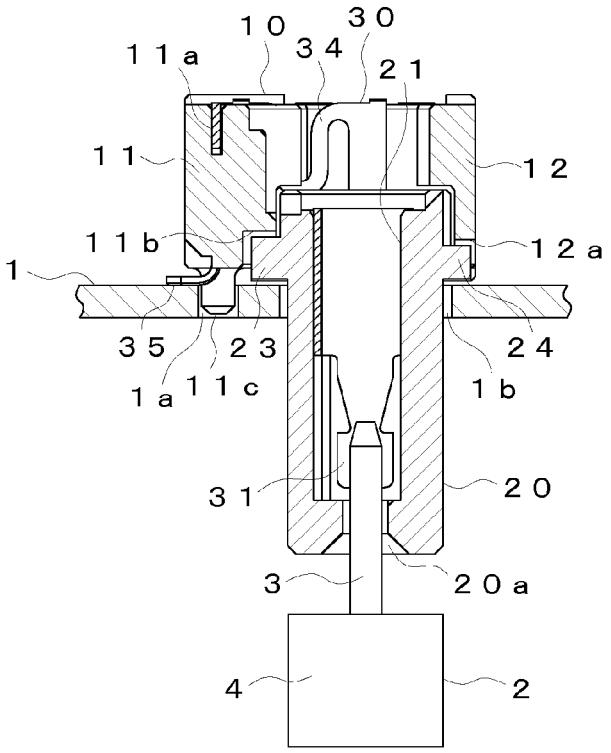
FIG. 10 is a cross-sectional view of a side of the connector with a connected mating connector.
Figure 11:
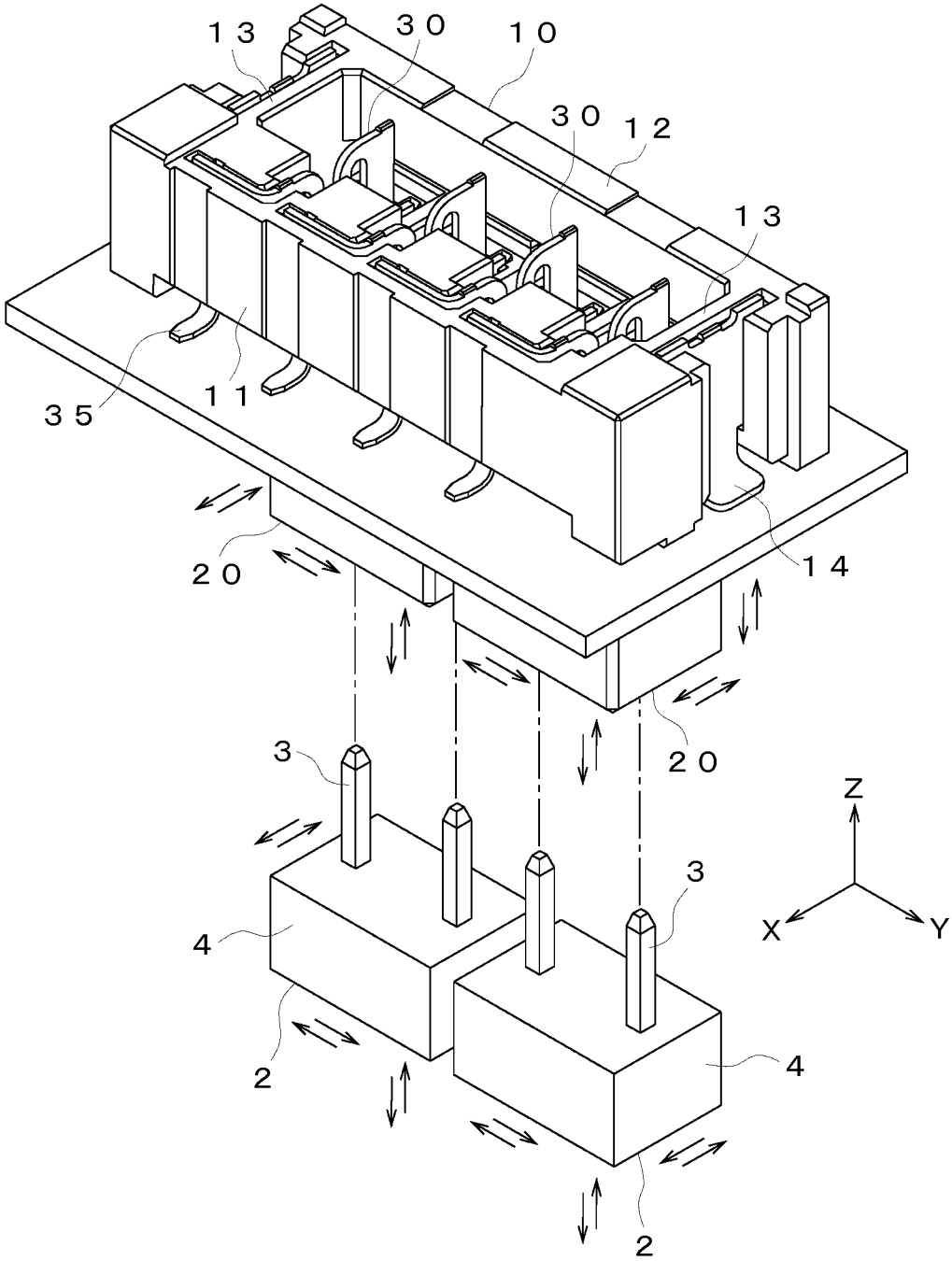
FIG. 11 is a perspective view of the connector and the mating connectors.

Subsequently, when the mating connectors 2 are connected to the connector, one of the mating connectors 2 is connected to one of the movable housings 20 while the other mating connector 2 is connected to the other movable housing 20. Specifically, as shown in FIG. 10, the mating terminals 3 of the mating connectors 2 are inserted into the insertion openings 20*a* of the movable housings 20 from below the substrate 1, connecting the mating terminals 3 to the terminals 30 in the movable housings 20. At this point, the mating terminals 3 inserted into the movable housings 20 are held by the contact portions 31*a* of the contact portions 31 while pressing the contact portions 31 of the terminals 30 to the outside. The contact portions 31*a* pressed into contact with the mating terminals 3 connect the mating terminals 3 and the terminals 30. When the mating terminals 3 are pressed between the contact portions 31, the movable portions 34 of the terminals 30 are elastically deformed so as to move the movable housings 20 upward. The first and second protrusions 23 and 24 are brought in contact with the first and second concave portions 11*b* and 12*a* of the stationary housing 10, regulating an upward movement of the movable housings 20. This does not excessively cause upward elastic deformation on the movable portions 34 of the terminals 30.

In the connected condition, if the substrate 1 and the mating connectors 2 are displaced from each other by vibrations or an impact, a movement of the movable housing 20 is accepted by the elastic deformation of the movable portions 34 of the terminals 30 so as to absorb the displacement. At this point, for example, if only some of the mating connectors 2 are displaced from the substrate 1 or the mating connectors 2 are displaced in different directions to each other, the movable housings 20 move with the mating connectors 2 so as to absorb the displacements of the respective mating connectors 2 by the respective movable housings 20.

When the mating connectors 2 are disconnected, the mating terminals 3 are pulled out of the terminals 30, elastically deforming the movable portions 34 of the terminals 30 so as to move the movable housings 20 downward. The first and second protrusions 23 and 24 in contact with the top surface of the substrate 1 regulate a downward movement of the movable housings 20. This does not excessively cause downward elastic deformation on the movable portions 34 of the terminals 30.

Thus, according to the present embodiment, the provided two movable housings 20 are formed by separate members that can move relative to each other. Thus, the displacements of the two mating connectors 2 connected to the movable housings 20 can be absorbed by the respective movable housings 20, thereby sufficiently absorbing the displacements of the mating connectors 2 relative to the substrate 1.

Moreover, the first and second protrusions 23 and 24 of the movable housings 20 are disposed between the top surface of the substrate 1 and the first and second concave portions 11*b* and 12*a* of the stationary housing 10. Thus, the movable housing 20 is configured such that an upward (one inserting/removing direction) movement of the mating terminal 3 is regulated at a predetermined position by the first and second concave portions 11*b* and 12*a* of the stationary housing 10 while a downward (the other inserting/removing direction) movement of the mating terminal 3 is regulated at another predetermined position by one surface of the substrate 1. When the mating terminal 3 is inserted or removed, the movable portion 34 of the terminal 30 does not undergoes excessive elastic deformation in the inserting/removing direction. This can reliably insert and remove the mating terminal 3 and prevent plastic deformation on the movable portion 34 of the terminal 30.

In the present embodiment, the two movable housings 20 are provided so as to move relative to each other. Three or more movable housings may be provided.

In the present embodiment, the mating terminals 3 are inserted into the movable housings 20 from below. The mating terminals 3 may be inserted from above.

The invention claimed is:

1. A connector comprising:

a stationary housing fixed to a substrate;

at least one movable housing that is movably provided relative to the stationary housing and allows insertion of a connection object from one end of the movable housing;

and a plurality of terminals, each being disposed with one end held by the movable housing and the other end held by the stationary housing, the connector configured to allow the connection object inserted into the movable housing to come into contact with one end of the terminal while causing elastic deformation of the terminals to accept a movement of the movable housing with respect to the stationary housing, the at least one movable housing comprising multiple movable housings, the movable housings extending through an opening in the substrate and being formed by comprising separate members that are capable of moving relative to each other.

2. The connector according to claim 1, wherein the movable housing is configured such that a movement of the connection object in one inserting/removing direction is regulated at a predetermined position by the stationary housing while a movement of the connection object in the other inserting/removing direction is regulated at another predetermined position by one surface of the substrate.

3. A connector comprising:

a stationary housing configured to be affixed to a substrate above a substrate opening, the stationary housing having at least one concave portion configured to orient toward the substrate opening and the substrate adjacent to the substrate opening;

a movable housing within the at least one concave portion, comprising multiple movable housings capable of moving relative to each other in at least two perpendicular directions, the movable housing being:

movably provided relative to the stationary housing, disposed in the stationary housing between the at least one concave portion and the substrate adjacent to the substrate opening and partly protruding through the substrate opening, and configured to receive a connection object inserted into one end of the movable housing; and a plurality of terminals, each having one end held by the movable housing and the other end held by the stationary housing in the connector, the connector being configured to allow the connection object inserted into the connector to contact the terminal and cause elastic deformation of the terminal, and to allow the movable housing and the at least one concave portion of the stationary housing to contact during elastic deformation of the terminal.

4. A connector comprising:

a stationary housing configured to be affixed to a substrate;

a movable housing comprising multiple movable housings capable of moving relative to each other in at least two perpendicular directions and relative to the stationary housing, the multiple movable housings having at least one protrusion oriented toward the stationary housing and configured to impede removal of the movable housing from the stationary housing in an inserting/removing direction substantially perpendicular to a major surface of the substrate, the movable housing being configured to receive a connection object inserted into the movable housing in the inserting/removing direction; and a plurality of terminals, each terminal having one end held by the movable housing and the other end held by the stationary housing, the connector being configured:

to allow the connection object inserted into the movable housing of the connector to contact the terminal and cause elastic deformation of the terminal, and to allow the at least one protrusion of the movable housing to contact the stationary housing during elastic deformation of the terminal upon a motion of the connection object along the first direction.

* * * * *